US008328084B2

(12) United States Patent
Lipkowitsch et al.

(10) Patent No.: US 8,328,084 B2
(45) Date of Patent: Dec. 11, 2012

(54) DEVICE FOR RECEIVING AND/OR ISSUING PAYMENT MEANS AND/OR FOR PROCESSING VALUE DOCUMENTS

(75) Inventors: Nikolai Lipkowitsch, München (DE); Thomas Schönberger, Arnschwang (DE)

(73) Assignee: Giesecke & Devrient GmbH, Munich (DE)

( * ) Notice: Subject to any disclaimer, the term of this patent is extended or adjusted under 35 U.S.C. 154(b) by 260 days.

(21) Appl. No.: 12/744,261

(22) PCT Filed: Nov. 21, 2008

(86) PCT No.: PCT/EP2008/009894

§ 371 (c)(1),
(2), (4) Date: May 21, 2010

(87) PCT Pub. No.: WO2009/065602

PCT Pub. Date: May 28, 2009

(65) Prior Publication Data

US 2010/0264208 A1 Oct. 21, 2010

(30) Foreign Application Priority Data

Nov. 23, 2007 (DE) ..... 10 2007 056 428

(51) Int. Cl.
*G07D 11/00* (2006.01)

(52) U.S. Cl. ..... 235/379; 235/475

(58) Field of Classification Search ..... 235/379, 235/381, 383, 382, 375, 475
See application file for complete search history.

(56) References Cited

U.S. PATENT DOCUMENTS

| | | | | |
|---|---|---|---|---|
| 4,450,978 | A * | 5/1984 | Graef et al. | 221/13 |
| 4,612,864 | A * | 9/1986 | Beck et al. | 109/49.5 |
| 6,010,065 | A | 1/2000 | Ramachandran et al. | |
| 6,082,616 | A | 7/2000 | Lewis et al. | |
| 7,168,613 | B2 * | 1/2007 | Douglass et al. | 235/379 |
| 7,367,492 | B2 * | 5/2008 | Shepley et al. | 235/379 |

(Continued)

FOREIGN PATENT DOCUMENTS

EP 1 093 092 A 4/2001

OTHER PUBLICATIONS

International Search Report in PCT/EP2008/009894, Apr. 6, 2009.

*Primary Examiner* — Thien M Le
(74) *Attorney, Agent, or Firm* — Bacon & Thomas, PLLC

(57) ABSTRACT

An apparatus for accepting and/or dispensing payment and/or for processing value documents having a housing in which there is disposed a control device for controlling at least one part of the apparatus, the housing having a housing body with a housing opening, a housing element movable relative to the housing body, and a housing element holding device that holds the housing element movably on at least one part of the housing body, and a display device controlled by the control device for displaying operating and servicing information which is held on the housing element. The housing element holding device is configured so that the housing element reciprocates between an operating position in which the housing element at least partly closes the housing opening, and a servicing position in which the housing element at least partly releases the housing opening, where the display device in the operating position is oriented with respect to the display device in the servicing position so as to be rotated by an angle that is smaller than 90°.

22 Claims, 10 Drawing Sheets

U.S. PATENT DOCUMENTS

| | | | | |
|---|---|---|---|---|
| 7,780,072 | B1 * | 8/2010 | Lute et al. | 235/379 |
| 7,810,715 | B2 * | 10/2010 | Herd et al. | 235/379 |
| 2003/0209598 | A1 | 11/2003 | Dollhopf | |
| 2004/0129772 | A1 * | 7/2004 | Ramachandran et al. | 235/379 |
| 2004/0222286 | A1 | 11/2004 | Douglass et al. | |
| 2005/0026702 | A1 | 2/2005 | Cole | |
| 2007/0114272 | A1 | 5/2007 | Bleck et al. | |
| 2009/0057398 | A1 * | 3/2009 | Douglass et al. | 235/379 |

* cited by examiner

DEVICE FOR RECEIVING AND/OR ISSUING PAYMENT MEANS AND/OR FOR PROCESSING VALUE DOCUMENTS

FIELD OF THE INVENTION

The present invention relates to an apparatus for accepting and/or dispensing means of payment and/or for processing value documents.

BACKGROUND

Means of payment will hereinafter be understood to be checks, accordingly adapted magnetic-stripe and/or chip cards, NFC devices (near field communication devices) with a corresponding function, for example mobile phones or chip cards, coins and value documents.

Value documents will be understood here to be sheet-shaped objects that represent for example a monetary value or authorization and are hence not to be producible at will by unauthorized persons. Hence, they have features that are not easily produced, in particular copied, whose presence is an indication of authenticity, i.e. production by an authorized body. Important examples of such value documents are coupons, vouchers, checks and in particular bank notes.

For accepting and/or dispensing such means of payment or for processing value documents it is common to use automatically working apparatuses which are operated by a person hereinafter designated the user or customer. To impede or prevent tampering by the user, the components of such apparatuses, for example card readers, coin accepting and/or dispensing devices and/or value-document accepting and/or dispensing devices, are disposed within a housing of the apparatus. Such a housing also permits protection of the components from soiling and other unfavorable influences, as well as an attractive design.

For controlling the components there is normally provided a control device which controls a display device, for example a screen, in order to permit information, for example about the operation of the apparatus or relating to a payment carried out by means of the means of payment or value documents, to be shown to a user.

For servicing of the components and for elimination of disturbances by persons hereinafter designated servicing persons, it is necessary that the housing is opened. The servicing person can then carry out the servicing work.

In particular for the installation of such apparatuses in business rooms, for example of banks or retail trade, as compact a design as possible would be advantageous for such apparatuses.

However, a compact design can lead to an apparatus that is awkward or elaborate to service when the components of the apparatus are poorly accessible.

SUMMARY

Hence, the invention is based on the object of providing an apparatus for accepting and/or dispensing means of payment and/or for processing value documents which allows a compact design at the same time as good serviceability.

This object is achieved by an apparatus for accepting and/or dispensing means of payment and/or for processing value documents having a housing in which there is disposed a control device for controlling at least one part of the apparatus, said housing having a housing body with at least one housing opening, a housing element movable relative to the housing body, and a housing element holding device by means of which the housing element is held movably on at least one part of the housing body, and said apparatus having a display device controlled by the control device for displaying operating and servicing information which is held on the housing element, wherein the housing element holding device is so configured that the housing element reciprocates between an operating position in which the housing element at least partly closes the housing opening, and a servicing position in which the housing element at least partly releases the housing opening, wherein the display device in the operating position is oriented with respect to the display device in the servicing position so as to be rotated by an angle that is smaller than 90°.

The apparatus thus has the housing which accommodates inter alia the control device. In the housing there can also be located at least one further component which is used for accepting and/or dispensing means of payment and/or processing value documents. In particular, the component can be selected from the group comprising coin accepting device, coin dispensing device, coin accepting and dispensing device, value-document accepting device, value-document dispensing device, value-document accepting and dispensing device, parts of the same, reader for cards, in particular cards with chips (smart cards) or magnetic stripes, reservoir for coins, reservoir for value documents, check and/or coupon accepting device, sorting devices, singler and stacker. Said components are connected to the control device via at least one signal connection and are controlled thereby or emit signals to be processed by the control device. The control device, which may be for example a data processing device suitably programmed for the purpose of the apparatus, is connected via a signal connection to the display device, and emits signals thereto which the display device converts to corresponding representations, for example images and/or text. Because the display device can serve as a visual interface for a user, it is preferably so disposed that a user located in front of the apparatus can read it.

The housing has the housing body which can itself have a plurality of interconnected elements, and the housing element which serves to close a housing opening via which the interior of the housing is accessible. The housing element is held movably for servicing purposes on the housing body by means of the housing element holding device and can be reciprocated between the operating position and the servicing position.

To allow a compact arrangement at the same time as simple servicing, the display device is held on the housing element, so that in the operating position a user or customer can view or read the display device. In this position the housing opening is covered at least partly by the housing element. In principle, the housing element can cover the housing opening completely. Upon partial covering, areas of the housing opening that are not covered by the housing element can be closed by at least one further movable housing element of the housing, for example a swiveling door. All in all, a user then has no access to the interior of the housing.

For servicing purposes, however, the housing element can be moved into the servicing position and then also at least partly releases the housing opening, so that access to the interior of the housing is possible. Depending on the type of housing body, it may here too be necessary to move a possibly existing further movable housing element of the housing, for example the previously mentioned door, in order for access to be effected through the total housing opening.

Servicing is facilitated not only by the movability of the housing element, however, but primarily also by the housing element being so aligned in the servicing position permitted by the housing element holding device, relative to the operating position that the display device is oriented with respect to the position in the operating position so as to be rotated by an angle of less than 90°. In the case of a display device with a level surface, this means for example that the angle that the normals to the surface enclose with each other at the same place on the display device in the operating position and servicing position of the housing element is smaller than 90°, preferably smaller than 70°, particularly preferably smaller than 50°. Thus, the display device can be employed at the same time for displaying information upon servicing of the apparatus; the person carrying out the servicing has access to the housing opening and can at the same time view the display device.

Preferred embodiments and developments are described in the description, the claims and the drawings.

In principle, the housing element holding device can allow any motion path of the housing element between the operating position and the servicing position. An especially simple and, at the same time, stable structure is obtained, however, by the housing element holding device limiting the motion of the housing element between the operating position and servicing position to a plane.

To allow especially good viewing of the image on the display device, the housing element holding device is then preferably so configured that the housing element in the servicing position encloses with the housing element in the operating position an angle that is smaller than half the viewing angle of the display device in the plane. The viewing angle is understood here to be the maximum angle between two viewing directions in the plane in which the display is still clearly readable. Corresponding data are stated for given viewing directions by the manufacturers for example for LCD screens as display devices.

In principle, the housing element holding device can be constructed suitably for the function, but otherwise at will. For example, it can comprise a linear guide. Greater freedom in the design of the housing and better access to the interior of the housing can be obtained, however, when the housing element holding device has two swivel axes preferably aligned parallel to each other. Depending on the configuration of the housing element holding device, the swivel motions around said swivel axes can be coupled.

The housing element holding device can for this purpose comprise for example one or two arms which are bendable at corresponding joints in each case doubly, preferably independently of each other. This permits an especially flexible adjustment of the position of the housing element.

Especially stable holding can be obtained in a simple manner by the housing element holding device comprising at least one four-joint lever which has the two swivel axes. Preferably, two such jointed levers are provided. A four-joint lever is understood to be in particular a device comprising two lever arms which are held at their ends swivel-mounted on the housing element on one side and the housing body on the other side, wherein the motion of one lever arm of the four-joint lever is limited by the other lever arm of the same four-joint lever. This makes it possible to achieve a motion of the housing element along a path, at the same time as swiveling.

The motion of the housing element between the servicing position and the operating position can in principle take place in any directions.

An especially space-saving apparatus can be obtained, however, by the housing element holding device being so configured and disposed that the reciprocating motion takes place at least partly vertically. The housing element can then be moved for example upwardly for servicing, so that there is no space requirement laterally of the apparatus for servicing.

For this purpose, in particular at least one of the swivel axes can be aligned horizontally. Preferably, both swivel axes are aligned horizontally.

However, the housing element holding device can preferably also be so configured and disposed that the reciprocating motion takes place at least partly horizontally. The servicing person can then look to the side at the display device in the servicing position, which can be more comfortable than looking upward.

In particular in this case, at least one of the swivel axes is preferably aligned vertically. Preferably, both swivel axes extend vertically.

Fundamentally, the motion of the housing element between the two positions can be effected by hand. In particular then, it is preferable that at least one resilient element is provided which is tensioned upon motion into the operating position, and upon release of the housing element from the operating position exerts on the housing element or the housing element holding device a force or a torque which supports a motion of the housing element into the servicing position. The resilient element may be for example a spring, in particular helical spring, acting on the housing element holding device, or a gas-filled damper. The use of gas-filled dampers offers the advantage that the motion of the housing element is effected in damped fashion and damage through excessively fast or sudden motion can be avoided.

Alternatively or additionally, there can be provided in the apparatus an, in particular electrical, drive device for reciprocating the housing between the operating and servicing positions. For example, there can be employed for this purpose an electric motor which is connected mechanically to elements of the housing element holding device via a gearing and is controlled by the control device. The control device can then be configured in particular in such a way that it controls the electric motor for moving the housing element into the servicing position only when the control device has received a predetermined authorization signal, for example via a user interface.

As mentioned above, the housing opening preferably permits access to at least one apparatus component disposed within the housing. In particular, the component can be selected here from the group comprising coin accepting device, coin dispensing device, coin accepting and dispensing device, value-document accepting device, value-document dispensing device, value-document accepting and dispensing device, part [sic] of the same, reader for cards, in particular cards with chips (smart cards) or magnetic stripes, store for coins, reservoir for value documents, check and/or coupon accepting device, sorting devices, singler and stacker. In this manner, servicing can be substantially facilitated. Furthermore, the display device can be disposed in front of at least one part of the component without preventing access to the component. Alternatively, it would otherwise be necessary to dispose the display device beside the component, which could substantially increase the space requirement for the apparatus.

In particular, the apparatus can have within the housing a receiving means for at least one reservoir for coins or value documents, in particular bank notes, coupons or checks, which is so disposed that the reservoir is insertable into the receiving means and removable therefrom through the housing opening. This has the advantage that replacement or emptying of the reservoirs as a servicing measure can be effected in a simple manner.

Additionally or alternatively, a component disposed within the housing can be held movably by means of a component holding device such that it is movable at least partly into and/or through the housing opening while being held on the component holding device. The components in question may be in particular components according to the above-mentioned enumeration.

Additionally or alternatively, in the apparatus, at least one component of the apparatus can be fastened detachably within the housing by means of a fastening device such that the fastening is detachable or producible through the housing opening. The fastening device may involve for example screws. However, possible fastening devices are also devices for inserting or suspending the component.

In many cases the apparatus will contain value documents or coins during operation, so that protection from unauthorized access to the interior of the apparatus is desirable. For this purpose there can be provided at least one locking device by means of which the housing element is lockable in the operating position. For example, there could be provided for this purpose a lock. To impede unauthorized access using a relatively great action of force, there are preferably provided, in the apparatus, lockable and unlockable locking devices each having a locking element and a locking element complementary thereto held on the housing body, in order to lock the housing element in the operating position. The housing element then has at least four edges meeting at corners, and two of the locking elements are spaced apart along at least one of the edges and/or one of the locking elements is disposed in each case in the area of at least two of the corners. This safeguarding has the advantage that forcing open along one of the edges or on one of the corners is greatly impeded.

The locking elements can be provided on the housing element, which makes it possible to effect a direct locking of the housing element on the housing body. It is also possible, however, that the housing element holding device is connected to the housing element in the area of two corners thereof and has one of the locking elements in the area of each of said corners. In other words, it is then possible for a locking of the housing element in the operating position to be effected by locking the housing element holding device in the operating position. This has the advantage that a very stable fastening of the housing element to the housing element holding device also permits a very stable locking.

If a plurality of locking devices are provided, it is conceivable that each of the locking devices is lockable independently of the others. This can increase safety, but also means greater effort for unlocking the housing element. When low effort plays an important part, the locking elements and/or the complementary locking elements of at least two of the locking devices are preferably coupled by means of a coupling device such that the locking devices are lockable and unlockable in coupled fashion. The coupling device can have fundamentally any gearing elements, for example lever, rod or similar elements. An especially simple structure is permitted when the coupling device has at least one cable pull. In the case of a motor drive of the locking devices, the coupling device can be given by corresponding means of the control device by means of which the drives are controllable in coordination with each other for unlocking and preferably also for locking.

Depending on the size of the housing element, it may be necessary that the housing body has a further movable housing element which is used for access to the interior of the housing. In particular, the apparatus can have a further swiveling housing element for which there is likewise provided a locking device with a locking element held on the further housing element and a complementary locking element held on the housing body, wherein the locking device for the further swiveling housing element is so coupled with at least one of the other locking devices that the latter is lockable and unlockable together with the other locking device. For the coupling there can be employed a further coupling device which is coupled with the coupling device that couples the at least two locking devices for the housing element. It can have in particular at least one of the above-mentioned elements. For coupling the locking devices, however, there can also be employed a single coupling device.

The display device can have in principle any kind of display elements. In particular, it can contain CRT screens or preferably LCD screens or OLED screens. Preferably, the display device comprises a touch-sensitive display, i.e. a "touch screen". This solution allows the display device to be employed as an input interface. This firstly makes it possible to do without a separate keyboard, which saves space, and secondly allows more intuitive operation. Furthermore, the display device can also be used for inputs during servicing, which can substantially facilitate servicing.

An especially compact design of the apparatus can be achieved when the housing element carries at least one further interface component. Interface components are understood to be in particular devices connected to the control device at least indirectly via signal connections, for capturing data and/or information and/or for outputting output of [sic] data and/or information. For example, these may involve keyboards, in particular ones for inputting personal identification codes such as PINs, card readers, readers for biometric features or similar devices. In particular, the housing element can extend over the total width of the apparatus or the total height of the apparatus.

The interface components and the display device must be supplied with energy and connected to the control device. For this purpose there can be provided in each case individual cables held in a drag chain. However, the apparatus preferably has a bus system by means of which the display device and the interface component or two interface components carried by the housing element are connected at least to the control device. Through the use of the bus system it may be sufficient to considerably reduce [sic] the number of cables for signal connections, which simplifies assembly and reduces susceptibility to trouble.

In this case it is particularly preferable that the bus system serves to supply the interface components carried by the housing element and connected to the bus system, and/or the display device with electrical energy. For example, there can be used for this purpose a USB 2.0 bus which, however, preferably has an amplified power supply compared with the standard.

BRIEF DESCRIPTION OF THE DRAWINGS

The invention will hereinafter be explained further by way of example with reference to the drawings. These show.

DETAILED DESCRIPTION OF VARIOUS EMBODIMENTS OF THE DISCLOSURE

Figure 1:
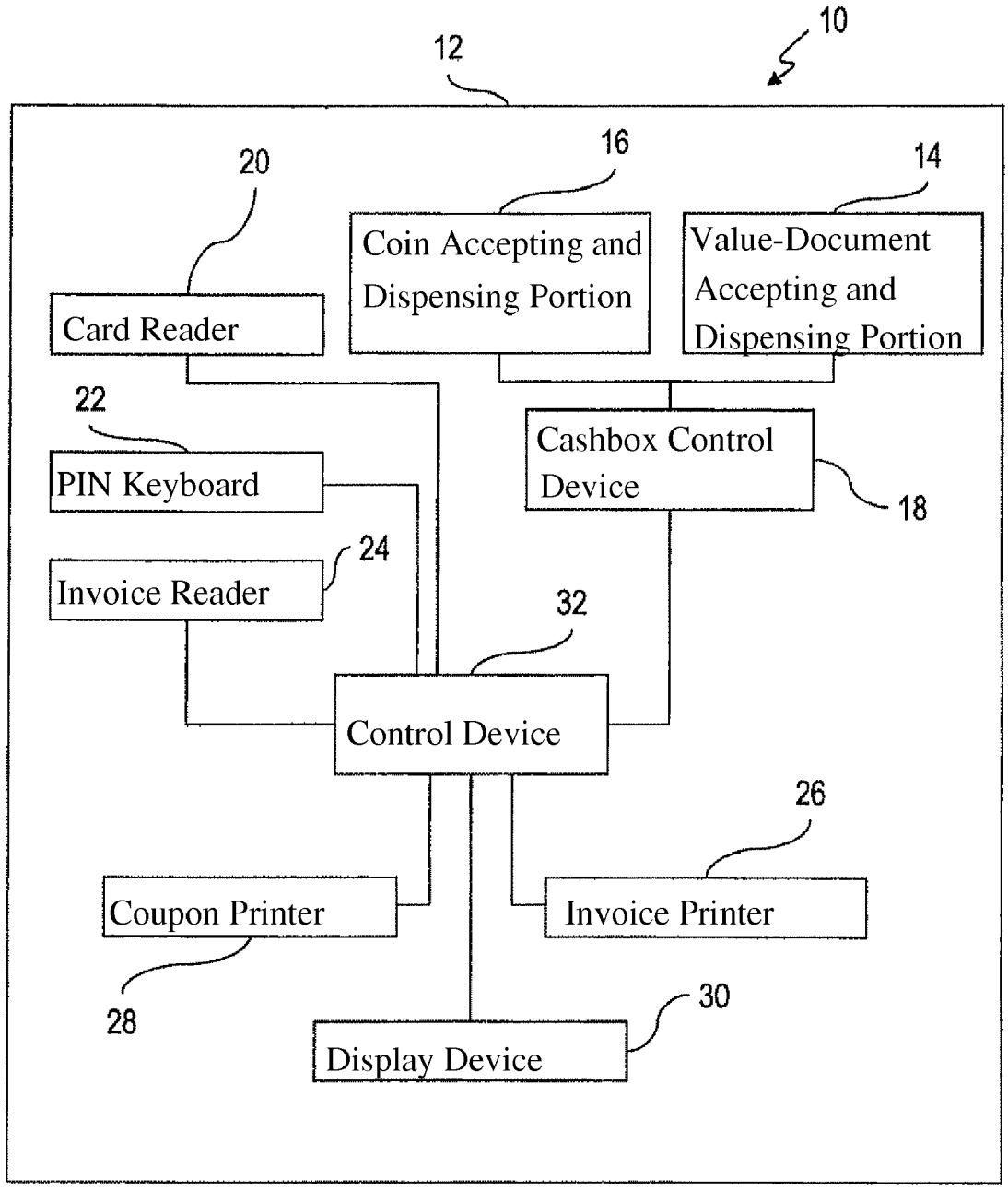
FIG. 1 a schematic block representation of an apparatus for accepting and dispensing means of payment in the form of a payment station, FIG. 2 a perspective view of the apparatus in FIG. 1 from the front and above, in which a movable housing element in the form of a hood is located in an operating position, FIG. 3 a perspective view of the apparatus in FIG. 2 in which the housing element and a door are omitted in order to show components within the apparatus, FIG. 4 a perspective view of the apparatus in FIG. 2 in which the hood is located in a servicing position and the interior of the housing is shown without components, i.e. empty, FIG. 5 a side view of the apparatus in FIG. 2 wherein the hood is located in the servicing position, a side wall, an intermediate wall and a value-document module are omitted and a coin module is shown in the state as drawn out of the interior of the housing, FIG. 6 a perspective partial view of the apparatus in FIG. 2 from the back, in which a housing back wall and a housing cover are omitted and a holding plate with a value-document module held thereon are shown, FIGS. 7A, 7B a partial side view of the apparatus in FIG. 2, wherein in particular the right side wall and the value-document module are omitted, and wherein the housing element is located in the operating position and servicing position, respectively, FIG. 8 a perspective view from the back and above of the left side wall, the housing element in the servicing position, a housing element holding device, of locking devices and a coupling device coupling the motion thereof, FIG. 9 a perspective view of the coupling device and of parts of locking apparatuses in FIG. 8 from the front right, and FIG. 10 a schematic partial view of the housing element holding device, the locking devices and the coupling device on the left side wall of the apparatus in FIG. 2.

A means-of-payment accepting and dispensing apparatus 10 in the form of a payment apparatus in FIGS. 1 to 4 possesses in or on a housing 12 inter alia a value-document accepting and dispensing device 14, hereinafter designated as a value-document module for short, a coin accepting and dispensing device 16, hereinafter designated as a coin module for short, a cashbox control device 18 connected to the value-document and coin modules via signal connections, for controlling the two modules, a card reader 20 with a keyboard 22 for inputting a PIN (personal identification number), and a NFC interface omitted in the figures for clarity's sake. For reading invoices, in this example in the form of documents with bar codes representing an invoice amount to be paid, there is used an invoice reader 24, in this example a bar-code reader. Invoices and coupons can be printed out by means of an invoice printer 26 or coupon printer 28. For outputting visually perceptible information and for capturing user inputs there is used a display device 30 in the form of a touch-sensitive LCD screen (touch screen display). A control device 32, which is held jointly with the display device 30, is used for controlling and for processing signals from the cashbox control device 18 and thus the value-document and coin modules, the card reader 20 with keyboard 22, the invoice reader 24 and the printers 26 and 28, and is connected thereto for this purpose via suitable signal connections.

For payment of an invoice amount, a document presented by a customer and having a bar code stating the invoice amount is read by means of the invoice reader 24 and the invoice amount is stored. The control device 32 then controls the display device 30 such that it displays the invoice amount and, in this exemplary embodiment, information about operating the apparatus. Then there are accepted or captured means of payment in the form of bank notes by means of the value-document module 14, coins by means of the coin module 16, chip-card or credit-card data by means of the card reader 20 and, if a PIN is necessary, the keyboard 22 or the NFC interface, and corresponding data representing the paid amount processed in the control device 32. Coupons are accepted by means of the value-document module 14 and processed similarly to bank notes, but not redispensed. The control device 32 checks in each case whether the invoice amount has already been paid and displays the balance yet to be paid. If the invoice amount has already been paid, it prevents a further acceptance of means of payment by controlling the cashbox control device 18 accordingly. It then controls firstly, where necessary, either the cashbox control device 18 to dispense a differential amount between paid amount and invoice amount in the form of bank notes and coins, or the coupon printer 28 to print out a coupon in the corresponding amount. It reads the relevant choice via the display device 30 on which a user can choose the dispensing of the return amount in the form of money or coupons by touching a corresponding area. Further, it controls the invoice printer 26 to print out and output an invoice with acknowledgement of the payment. Finally, it also emits a release signal which indicates that the amount has been paid. The signal can be used to unblock a locked exit gate.

Figure 2:
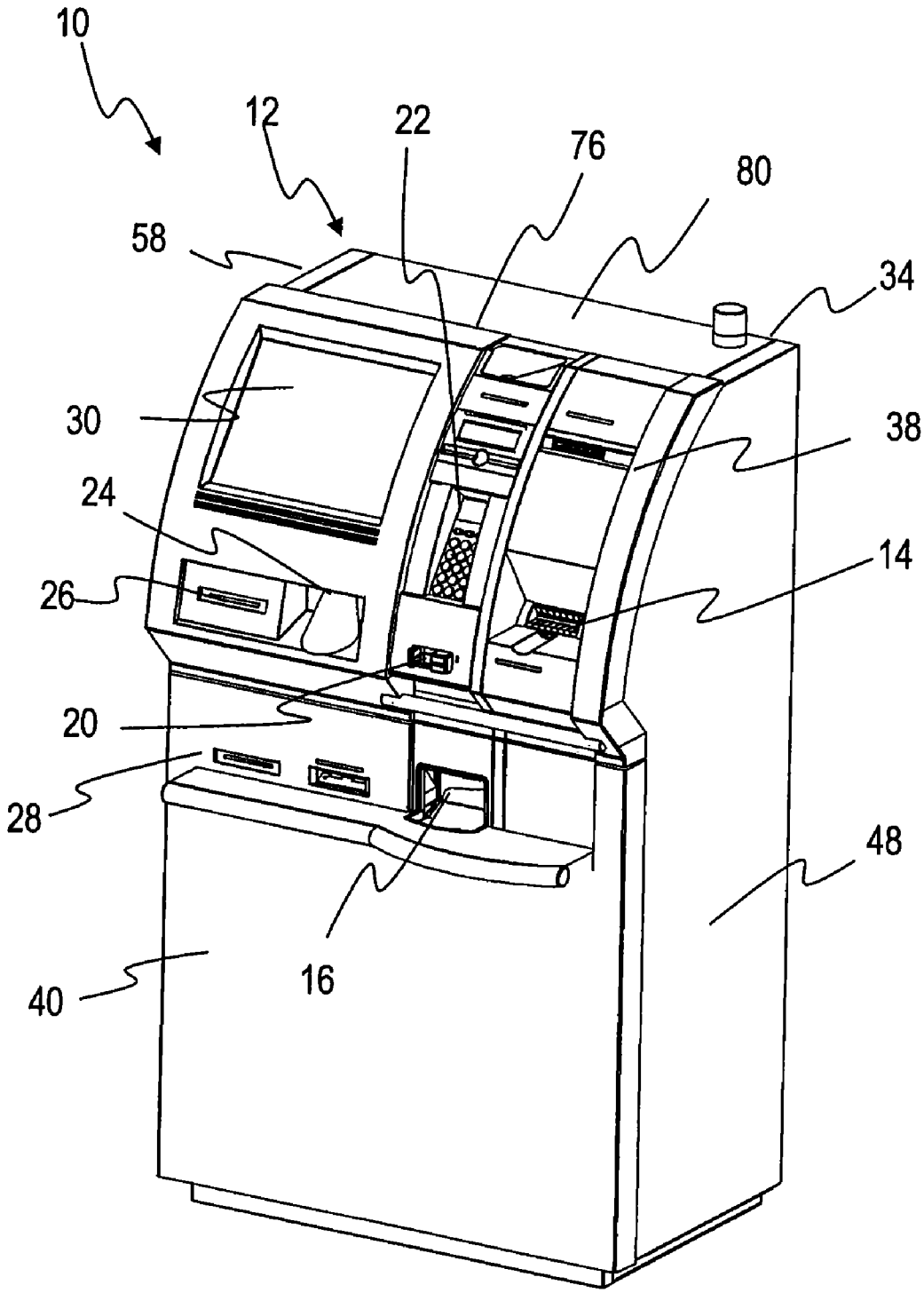
Figure 4:
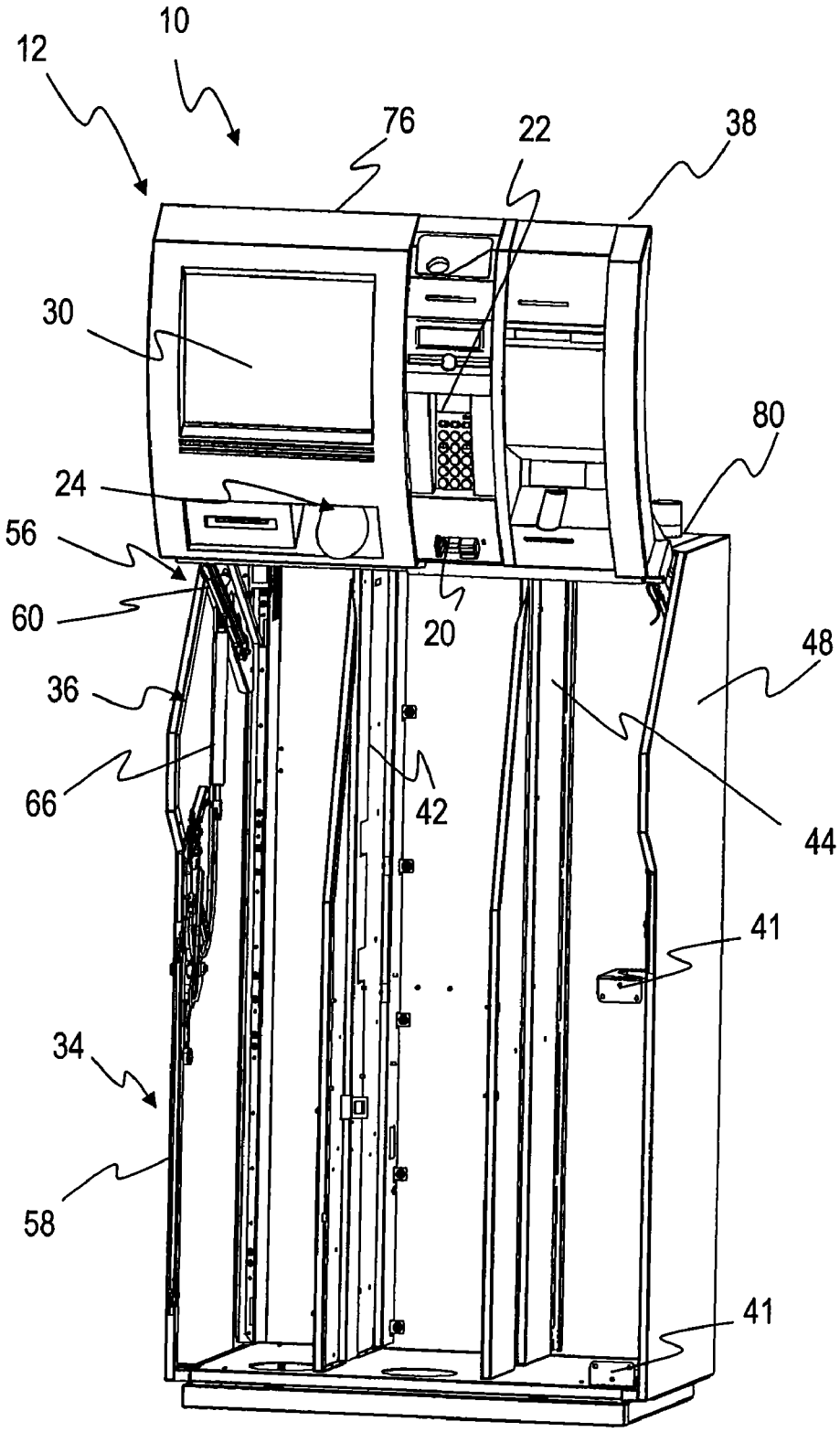

As illustrated in FIGS. 2 and 4, the housing 12 of the apparatus 10 comprises a housing body 34 which has on a side facing the user during operation a housing opening 36, a housing element 38 reciprocating between an operating and a servicing position, and a further housing element 40 likewise reciprocating between an operating and a servicing position, in this example a door swiveling around a vertical swivel axis given by hinge members 41 on the housing body 34.

In the operating position shown in FIG. 2, the housing element 38 and the door 40 close the housing opening 36 in each case partly, but together completely, so that a user cannot have any access to the above-mentioned devices disposed within the housing 12, except for the keyboard 22 and the display device 30.

Figure 5:
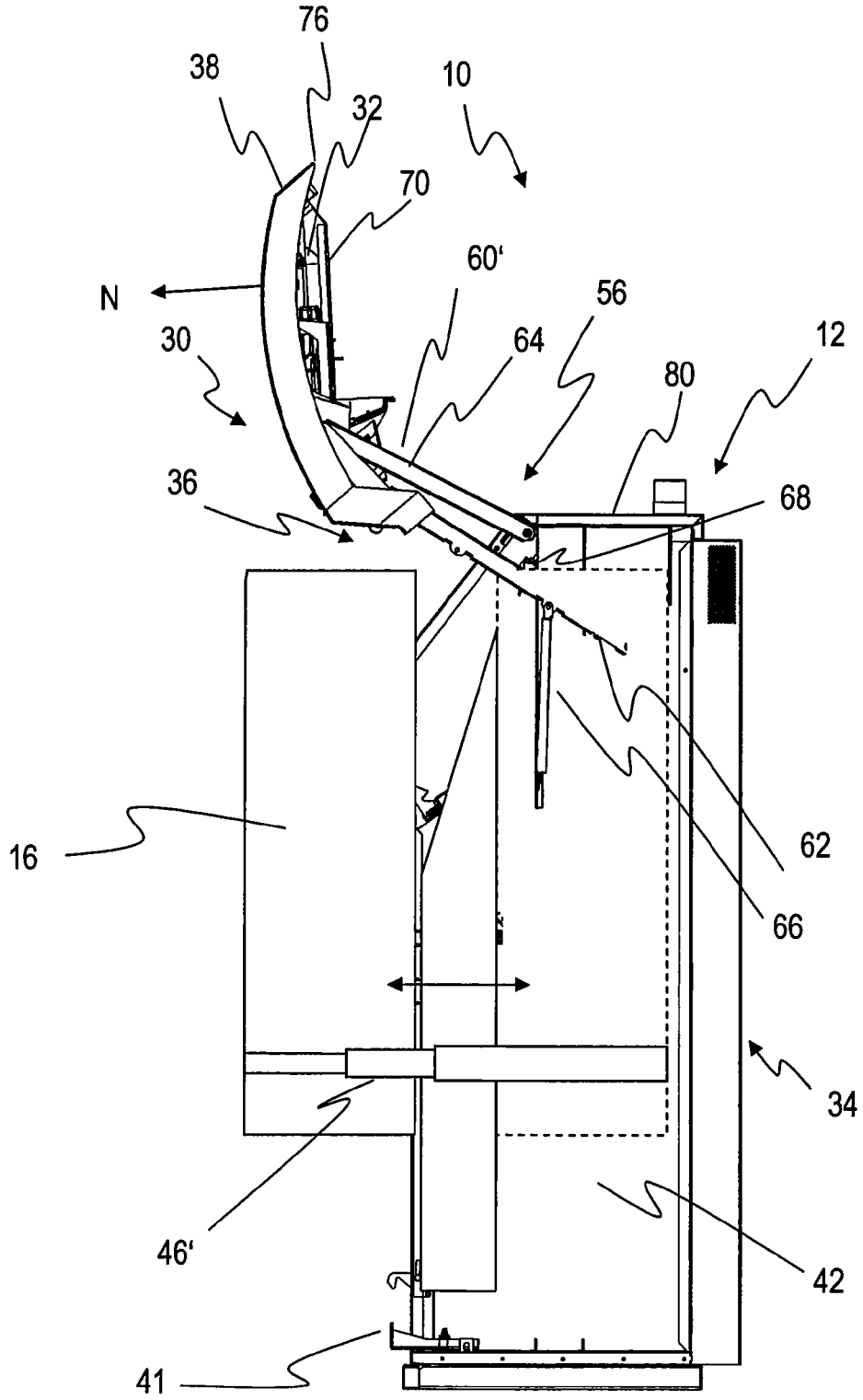
Figure 7A:
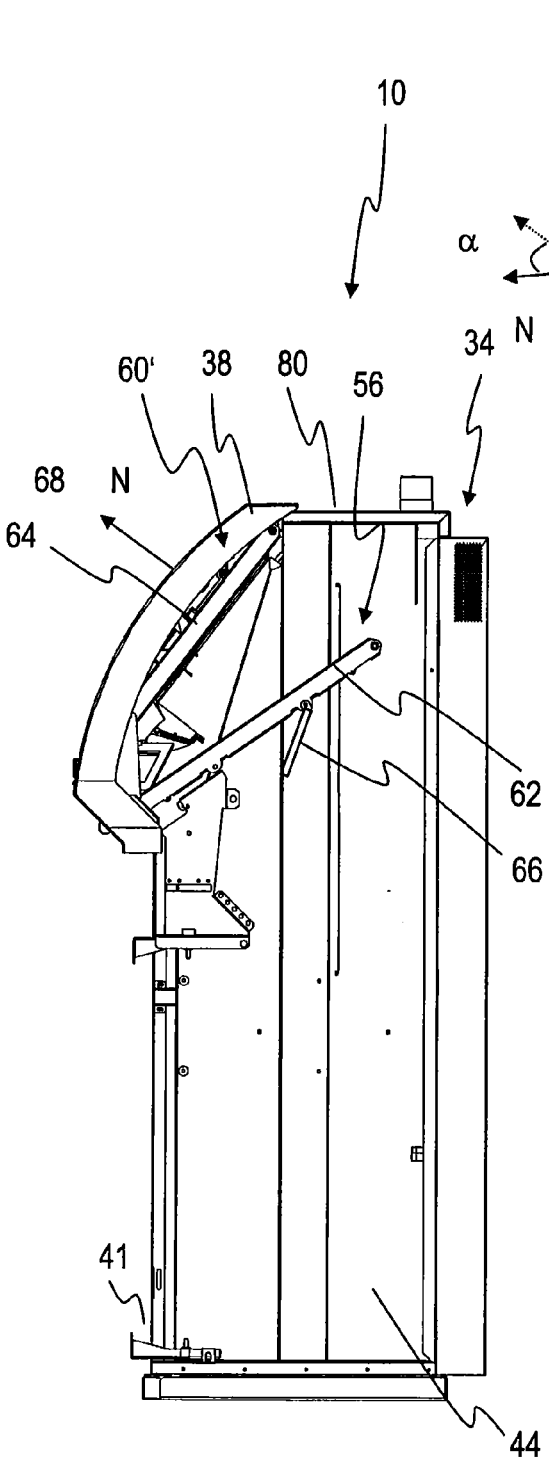
Figure 7B:
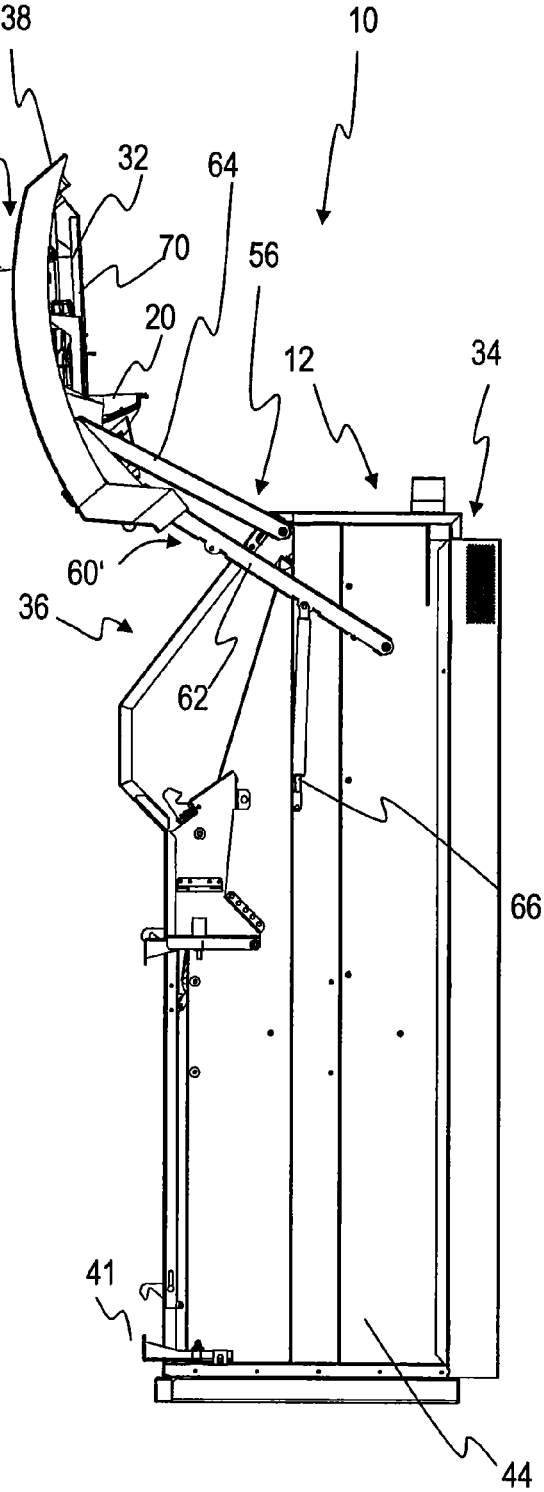

In the servicing position shown inter alia in FIGS. 4, 5 and 7B, however, in which the door 40 is swiveled open, and the housing element 38 is moved upward, an access to the interior of the housing 12 is possible through the housing opening 36.

Figure 3:
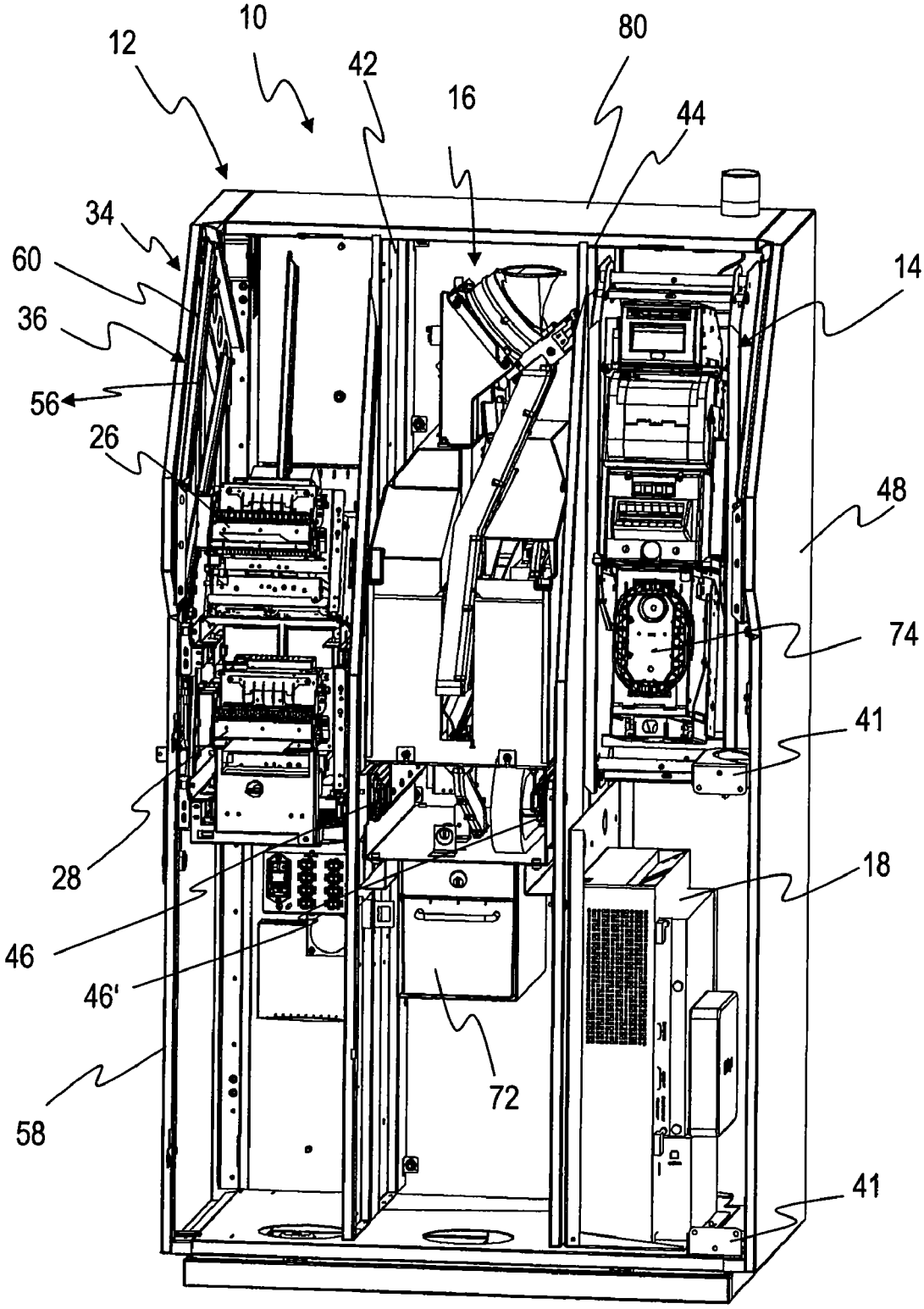

FIG. 3 shows the interior of the housing body 34 without the door 40 and the housing element 38. The housing body 34 comprises two intermediate walls 42 and 44 which divide the internal space thereof into three portions in which the hereinafter stated components of the apparatus are disposed and/or held.

In the portion on the left in FIG. 3 there are disposed as components inter alia the coupon printer 28 and the invoice printer 26.

In the middle portion there is located as a component the coin module 16 which is held in linearly movable fashion by means of a component holding device, in this example two telescoping rails 46 and 46', on the intermediate walls 42 and 44 of the housing body 34. By means of the telescoping rails the coin module 16 can be drawn out of the housing body 34 or pushed thereinto in a direction that is horizontal in FIG. 3. The coin module 16 is a recycling module, i.e. accepted authentic coins are stored temporarily to a predetermined extent and optionally redispensed as change. Coins not required for redispensing are stored in an overflow storage cassette or end cashbox.

Figure 6:
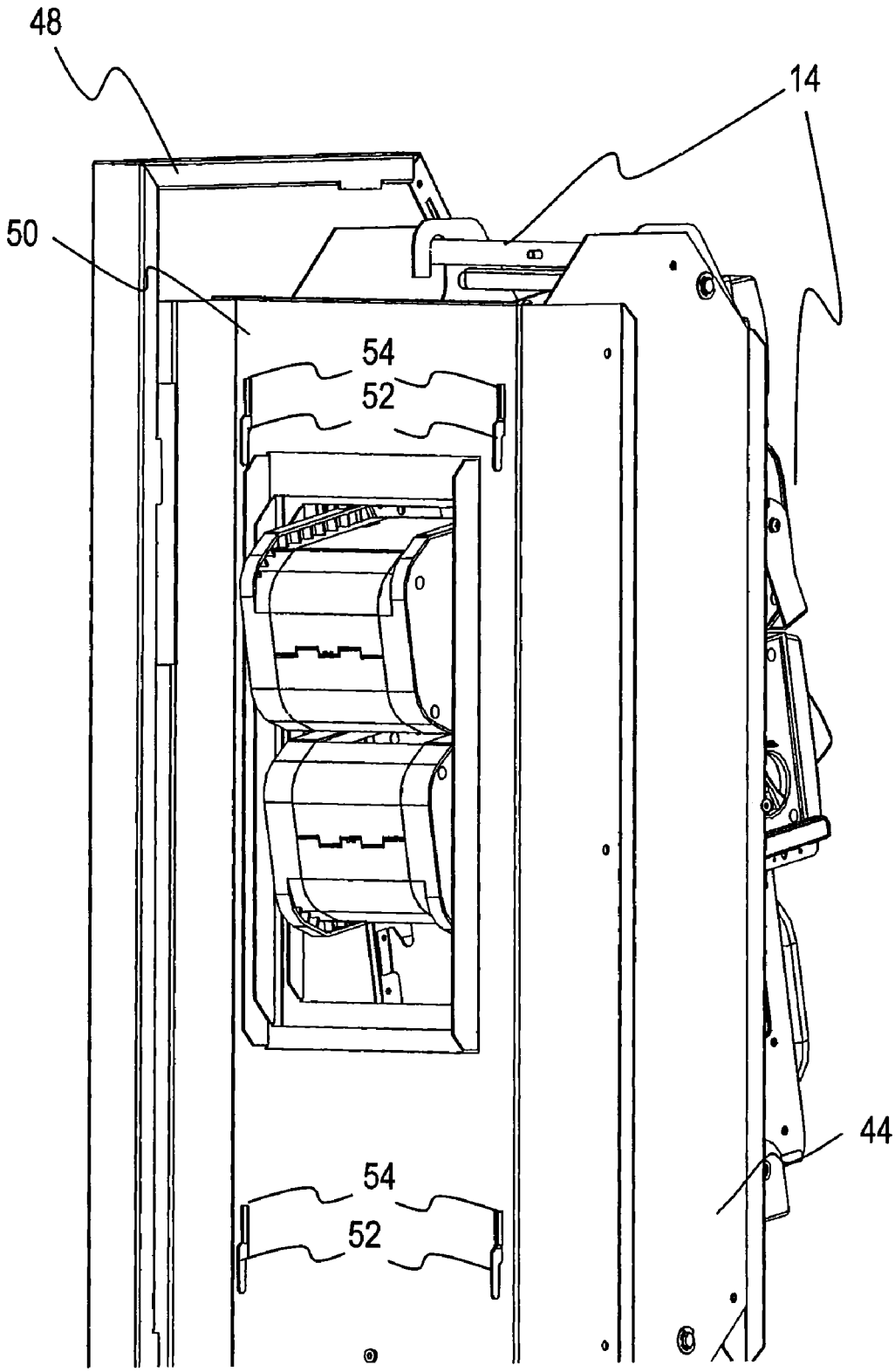

In the portion on the right in FIG. 3 there are located as components the value-document module 14 and the cashbox control device 18. The value-document module 14 is held detachably on a holding plate 50 between a side wall 48 and the intermediate wall 44 by means of a fastening device with fastening elements and complementary fastening elements. As illustrated more precisely in FIG. 6, the value-document module 14 has on its back wall four fastening elements 52, in this example in the form of downwardly open hooks, and the holding plate 50 and thus the housing body 34 four complementary fastening elements 54 disposed in accordance with the fastening elements 52, in this example in the form of slots by means of which the value-document module 14 is fastenable to the housing body 34. In the example the hooks 52 and thus the value-document module are hitched into the slots 54 for fastening, being unhitched for removal.

As shown in particular in FIGS. 7A and 7B as well as 8, the housing element 38 configured in a hood shape in this example is held movably by means of a housing element holding device 56 on the housing body 34, more precisely the side walls 48 and 58 thereof, such that the housing element 38 reciprocates between the operating position in which the housing element 38 at least partly closes the housing opening 36, and the servicing position in which the housing element 38 at least partly releases the housing opening 36. In the example, the housing element holding device 56 comprises two identically configured four-joint levers 60 and 60' which in each case have two arms 62, 64 swiveling around respective, horizontally extending axes and being held in each case at one end by means of a fastening plate 65 on the housing body 34 and the other end likewise by means of a fastening plate 65' on the housing element 38. The ends of the arms of a four-joint lever are held on the housing element side by means of the fastening plate 65' at a distance apart which is smaller than the distance between the opposing ends of the arms which are likewise held by means of the fastening plate 65 on the housing body 34. The use of respective pairs of arms 62, 64 makes it possible to obtain a coupling of the swivel motions which results in the housing element 34 firstly moving along a path upward, and secondly being rotated in its orientation in space.

Figure 8:
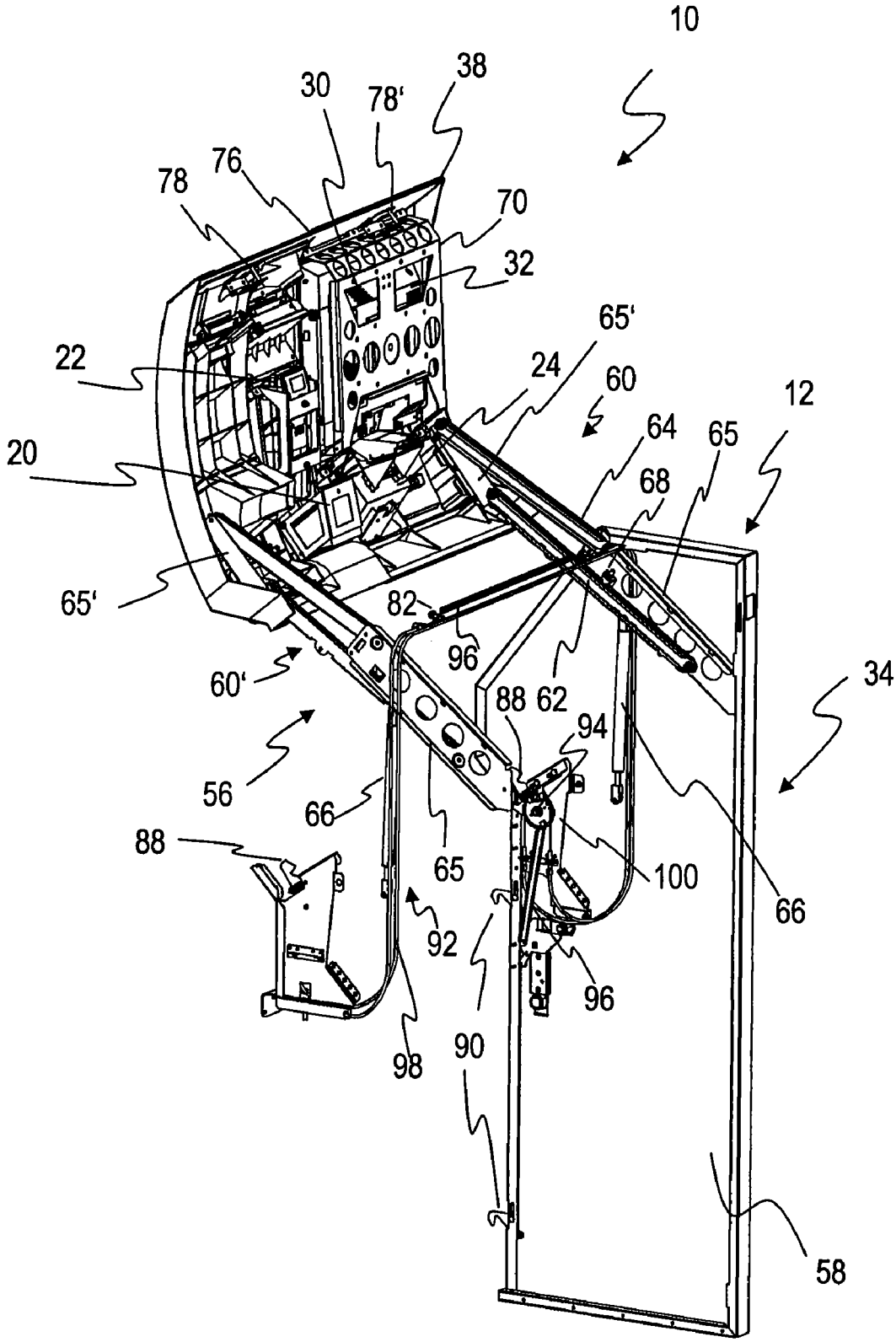

Said housing element holding device 56 thus has two horizontally extending swivel axes, namely the swivel axis through the lower fastening points in FIGS. 7A, 7B and 8 of the lower arms 62 on the housing body 34, and the swivel axis through the upper fastening points of the upper arms 64 on the housing element 38. This construction limits the motion of the housing element 34 to a plane, which extends vertically in the example.

To facilitate a motion of the housing element 34 out of the operating position in which it rests on the side walls 48 and 58, into the servicing position, there are fastened to the housing body 34, more precisely to the side walls 48 and 58 thereof, and the housing element holding device 56, more precisely the lower arms 62, in each case resilient elements 66, in the example gas-filled dampers, which are tensioned upon a motion into the operating position, and upon release of the housing element 34 in the operating position, upon tension release, exert force on the arms 62 and thus a torque by means of which the raising of the housing element 34 into the servicing position is at least facilitated. In the example, the raising is effected solely through the resilient elements 66. The use of the gas-filled dampers has the advantage that the motion of the housing element 38 is effected in damped fashion, so that hard braking in the servicing position can be avoided. For limiting the motion in the servicing position there are provided buffer elements 68 held on the housing body 34.

The housing element 38, like the door 40, has accepting and/or dispensing openings, not described in detail hereinafter, for value documents, coins and chip cards. Further, it carries the keyboard 22 and the card reader 20 as electrical components of the apparatus.

The display device 30 and the control device 32 are combined in one unit 68 which are [sic] held by means of a sheet metal cage 70 on the housing element 38 on the side facing the housing inner side such that the touch-sensitive LCD screen (touch screen) 30 is visible through a corresponding opening in the housing element 34 (cf. FIGS. 2, 4 and 8). The touch-sensitive screen has in the vertical direction (in the post-assembly position) a viewing angle of more than 90°, in the horizontal direction (in the post-assembly position) a viewing angle of more than 120°.

In the operating position the normal N on the screen surface of the display device 30 is so inclined relative to the vertical that a user standing in front of the apparatus can readily read representations on the display device and make any inputs by touching the screen surface.

In the servicing position the housing element 38 and thus the display device or the normal N on the screen surface thereof are raised relative to the operating position and rotated in the orientation thereof by an angle $\alpha$ smaller than 90°, in the example of about 40° (cf. FIG. 7B, in which the normal in the operating position is represented as a dotted arrow). A servicing person standing in front of the apparatus now has access through the upper part of the housing opening 36 or, after opening the door 40, to the total housing opening and can for example draw the coin module 16 out of the housing 12 for servicing purposes or remove the value-document module 14 from the housing. Furthermore, access to the other, above-mentioned components present in the housing body is of course given.

In particular, the coin and value-document modules possess overflow storage cassettes 72, 74, in which coins or value documents not intended for later use as change can be stored. They are respectively adapted to be pushed into or drawn out of the modules in the horizontal direction and, hence, can be removed from the housing body 34 in the servicing position, while being protected against access from outside in the operating position of the housing element 38.

In addition, it is further possible to use the display device 30 as an input interface, which can facilitate the servicing of the apparatus.

Figure 9:
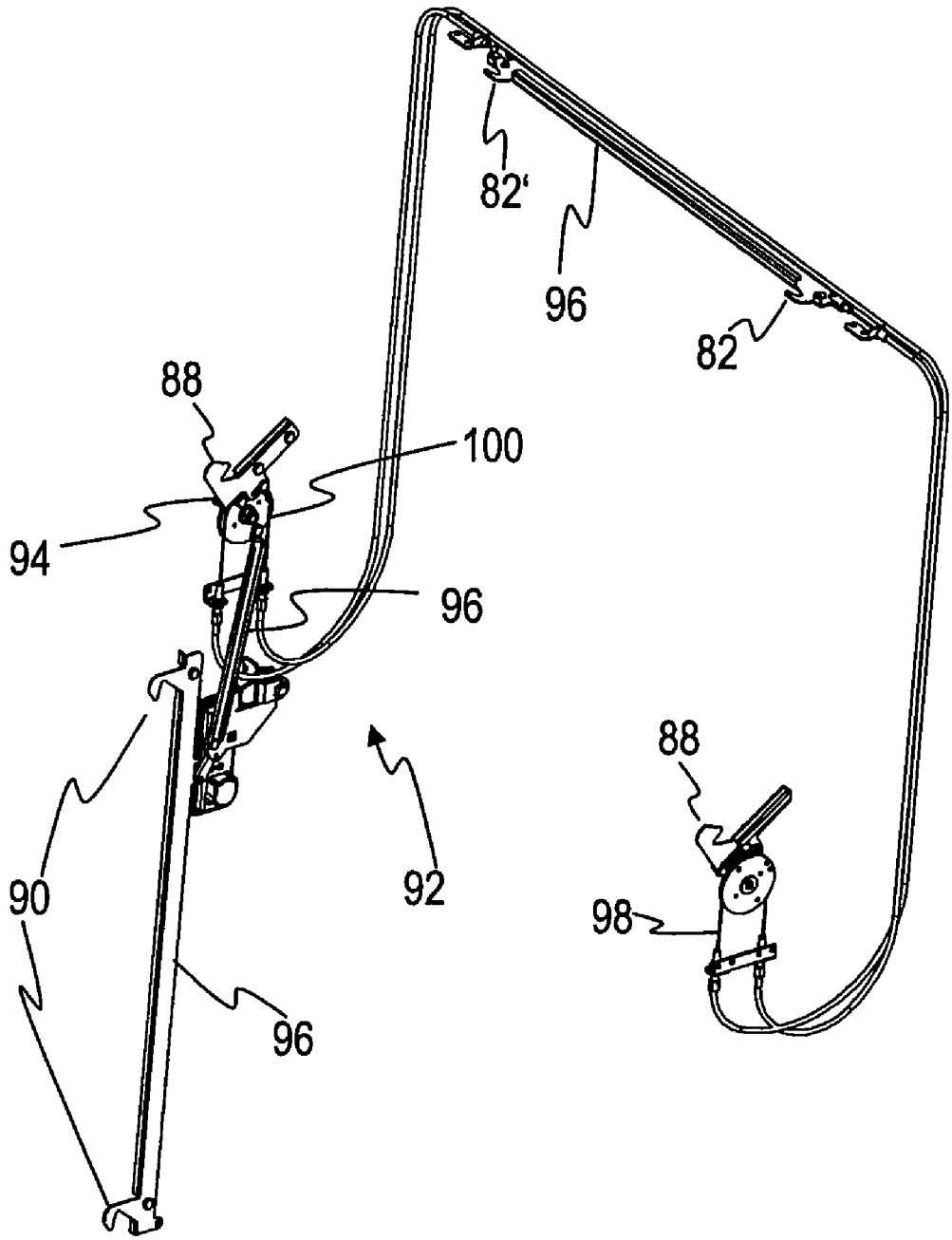
Figure 10:
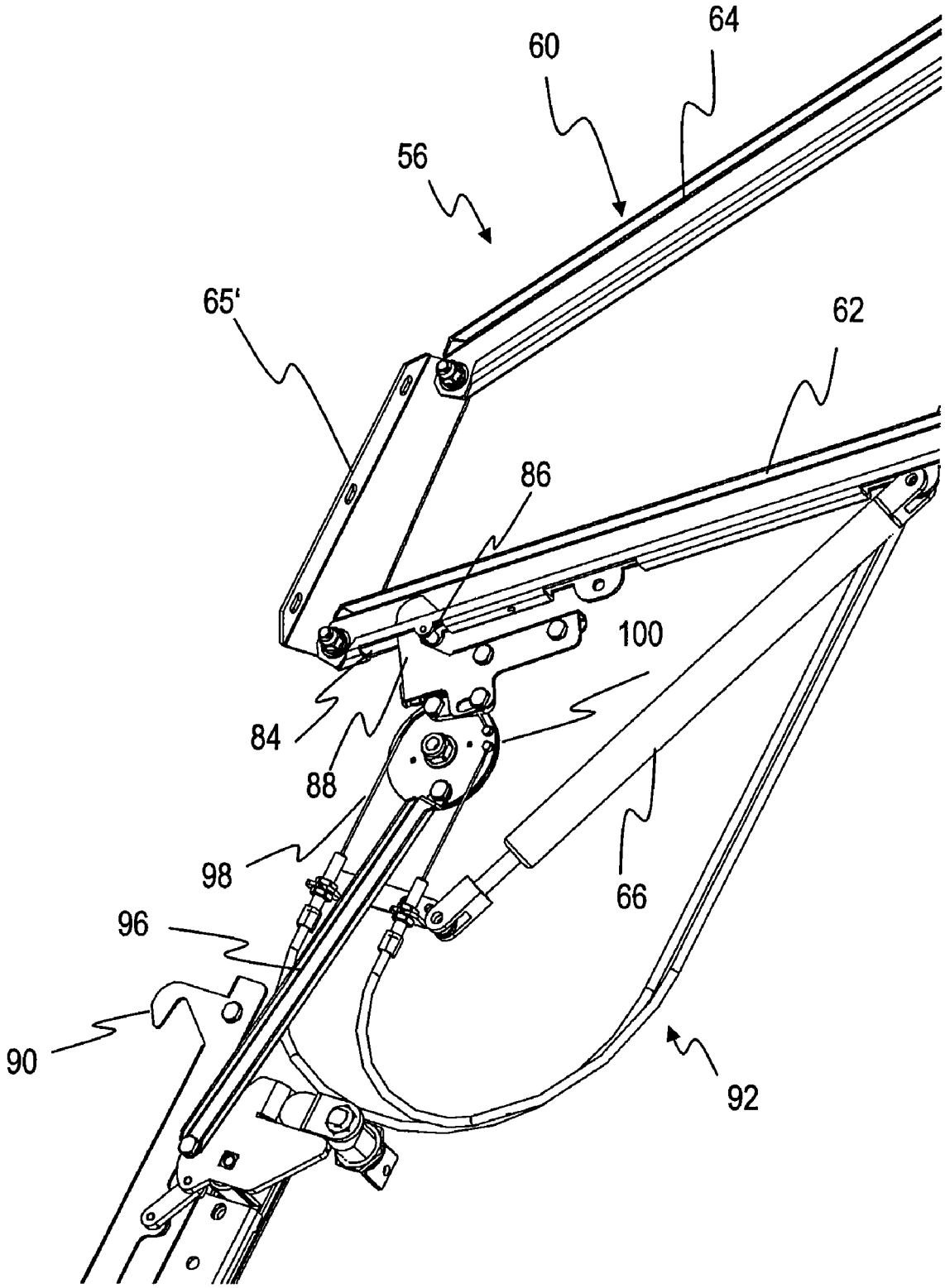

For protection of the housing 12 from unauthorized opening, lockable and unlockable locking devices are provided. This is illustrated in FIGS. 8 to 10 which in each case show only parts of the apparatus.

The housing element 38 possesses four edges meeting at corners. Along the upper edge 76 there are provided as locking elements 78 and 78' in each case U-shaped plates fastened to the housing element 38 apart [sic] along the edge, with bolts disposed between the free arms of the "U". On the housing body 34, more precisely the housing cover 80, there are provided along the corresponding edge, as complementary locking elements 82 and 82', hooks movable in a direction parallel to the edge. Before locking in the operating position the hooks 82 and 82' are located laterally of the locking elements 78 and 78' and, for locking, are moved with their free ends into the openings formed by the bolts and the U-shaped plates. Through this arrangement, forcing open of the housing element 38 along the edge is greatly impeded.

Further locking devices are provided respectively for the housing element holding device 56. At least the lower arms 62 have a U-shaped profile, as shown in FIG. 10, with one of the free arms of the "U" pointing downward. As locking elements there are used in this example slots 84 in the lower arms 62 of the four-joint levers, more precisely the lower one of two arms, and bolts 86 disposed in the area of said slots 84, into which for locking on the housing body 34, more precisely the side walls 48 and 58 thereof, complementary locking elements 88 in the form of hooks, which are in this example fastened to the housing body 34 in swiveling fashion, are movable for locking. Since the housing element holding device 56, more precisely the four-joint levers, is connected in the area of two corners of the housing element 38 thereto and has one of the locking elements in the area of each of said corners, a very stable locking is obtained.

Accordingly there are provided locking devices for the further swiveling housing element, the door 40. In the door there are likewise provided, as locking elements, openings configured on the door inner side and, as complementary locking elements, complementary locking elements 90 held on the housing body 34, more precisely the side walls 48 and 58, in this example in the form of hooks movable parallel to the edge of the side walls, being movable with their free ends into the openings.

The elements of the locking devices that are movable for locking are coupled by means of a coupling device 92 with each other and with a lock 94 held on the housing body 38 (cf. FIGS. 8 to 10). The coupling device 92 comprises rods 96 for coupling the motion of the complementary locking elements 82 and 82' with each other and the motion of the complementary locking elements 90 with each other, and a rotating cable pull 98 for coupling with the other complementary locking elements. The locking elements 96 coupled with the lock 94 by means of a further rod and an eccentric 100 connected thereto [sic].

Thus, by actuating the lock 94, i.e. turning the locking lever, it is possible to obtain a simultaneous motion of all complementary locking elements, thereby permitting simultaneous locking and unlocking of the housing elements 38 and 40.

The operation of the different components of the apparatus requires firstly electrical energy and secondly the distribution of signals between the control device 32 and the components connected thereto via signal connections, as well as the cashbox control device 18. Both the control device 32 and the cashbox control device 18 have a processor and memory in which there is stored a program for execution by the processor, which is processed during operation of the apparatus.

In this exemplary embodiment there are provided for each of the components, the display device, the card reader and the keyboard, separate cables for energy supply and as signal connections, which are not shown in the figures, and are guided in drag chains to ensure an orderly course of the cables upon opening of the housing.

Other exemplary embodiments differ from the described exemplary embodiment in that there is employed for the signal connections and preferably at the same time also the energy supply a, preferably serial, bus system which permits the connection of a plurality of components. If the energy supply of the bus system is made available within the device body, for example within the cashbox control device or through a distributor or hub, in sufficient strength for all components, the number of cable connections between housing element 38 and the housing body 34 or components disposed therein can be reduced.

In other exemplary embodiments there can be provided instead of the lock 94 an electric motor which is controlled by the control device 32. The control device 32 is then programmed to control the electric motor for unlocking only upon reading of a chip card inserted into the card reader 20 and authorizing servicing operations, and inputting of a code via the display device or also the keyboard.

In yet another exemplary embodiment, the door and the housing element are configured as an overall element and the four-joint levers are disposed on the housing cover and the bottom of the housing body, so that the overall element is movable in a plane between an operating position and an open position. Hence, the overall element can be moved out of the operating position into a servicing position in which the overall element is located at least partly beside and in front of the housing body 34, whereby the display device can again be viewed and operated by a person located in front of the apparatus.

A further exemplary embodiment differs from the previously described exemplary embodiments in that the apparatus is configured as a sorting apparatus, and for this purpose has an acceptance pocket for bank notes to be sorted, a singler for bank notes inserted into the acceptance pocket as a stack, a plurality of output pockets for receiving bank notes sorted into the particular output pockets according to a given sorting criterion, a transport device for transporting bank notes along a transport path from the singler to the output pockets, and a checking device disposed on the transport path for ascertaining the denomination and/or authenticity of bank notes transported along the transport path. A control device controls gates of the transport device in dependence on signals from the checking device such that each checked bank note is sorted into a corresponding one of the output pockets according to the result of the check by means of the checking device. For operation of the apparatus, in particular the selection of the sorting criterion, and the display of operating and process information, there is again used a display device connected to the control device and possessing a touch-sensitive display (touch screen). The specified components, except for the acceptance and output pockets and the display device, are again disposed within a housing which is configured like the housing in the first exemplary embodiment, whereby the movable hood-like housing element now only has openings for the acceptance and output pockets, however.

Yet another exemplary embodiment differs from the first exemplary embodiment in that there is provided at least one elastic element by means of which at least one of the locking devices are [sic] biased in their locking position. The particular locking element or complementary locking element is then preferably so configured that it is deflected against the bias out of the locking position through the housing element upon closing thereof so far that the housing element can be closed, whereupon it is moved back into the locking position by the bias.

The complementary locking elements 88 have for this purpose accordingly beveled hook ends. For the bias the elastic element used is a spring tensioned between the hooks 88 and a hold point connected to the housing body 34.

Additionally or alternatively there can be provided a suitably attached elastic element for the rod 96 whose hooks 90 are formed accordingly.

The invention claimed is:

1. An apparatus for acceptance and/or dispensing means of payment and/or for processing value documents, comprising:

a housing in which there is disposed a control device arranged to control at least one part of the apparatus and which has a housing body with a housing opening, wherein at least one apparatus component disposed within the housing is accessible through said housing opening, a housing element movable relative to the housing body, and a housing element holding device arranged to movably hold the housing element on at least one part of the housing body, and a display device controlled by the control device for displaying operating and servicing information which is held on the housing element, wherein the housing element holding device is configured so that the housing element reciprocates between an operating position in which the housing element at least partly closes the housing opening, and a servicing position in which the housing element at least partly releases the housing opening, and wherein the display device in the operating position is oriented with respect to the display device in the servicing position so as to be rotated by an angle that is smaller than 90° in a way such that the at least one apparatus component disposed within the housing is accessible through the housing opening while at the same time the display device is viewable.

2. The apparatus according to claim 1, wherein the housing element holding device limits the motion of the housing element between the operating position and the servicing position to a plane.

3. The apparatus according to claim 2, wherein the housing element holding device is so configured that the housing element in the servicing position encloses with the housing element in the operating position an angle that is smaller than half the viewing angle of the display device in the plane.

4. The apparatus according to claim 1, wherein the housing element holding device has two swivel axes preferably aligned parallel to each other.

5. The apparatus according to claim 4, wherein the housing element holding device comprises a four joint lever which has the two swivel axes.

6. The apparatus according to claim 5, wherein at least one of the swivel axes is aligned horizontally.

7. The apparatus according to claim 4, wherein at least one of the swivel axes is aligned vertically.

8. The apparatus according to claim 1, wherein the housing element holding device is so configured and disposed that the reciprocating motion takes place at least partly vertically.

9. The apparatus according to claim 1, wherein the housing element holding device is so configured and disposed that the reciprocating motion takes place at least partly horizontally.

10. The apparatus according to claim 1, wherein at least one resilient element is provided which is tensioned upon motion into the operating position, and upon release of the housing element out of the operating position exerts on the housing element or the housing element holding device a force or a torque which supports a motion of the housing element into the servicing position.

11. The apparatus according to claim 1, including a drive device that reciprocates the housing between the operating position and the servicing position.

12. The apparatus according to claim 1, including a receiver for at least one reservoir for coins or value documents which is so disposed that the reservoir is insertable into the receiver and removable therefrom through the housing opening.

13. The apparatus according to claim 1, wherein a component disposed within the housing is held movably by a component holding device such that it is movable at least partly into and/or through the housing opening while being held on the component holding device.

14. The apparatus according to claim 1, wherein at least one component of the apparatus is fastened detachably within the housing by a fastening device such that the fastening is detachable or producible through the housing opening.

15. The apparatus according to claim 1, including lockable and unlockable locking devices each having a locking element and a locking element complementary thereto held on the housing body, in order to lock the housing element in the operating position, the housing element having at least four edges meeting at corners, and two of the locking elements being spaced apart along at least one of the edges and/or one of the locking elements is disposed in each case in the area of at least two of the corners.

16. The apparatus according to claim 15, wherein the housing element holding device is connected to the housing element in the area of two corners thereof and has one of the locking elements in the area of each of said corners.

17. The apparatus according to claim 15, wherein the locking elements and/or the complementary locking elements of at least two of the locking devices are coupled using a coupling device such that the locking devices are lockable and unlockable in coupled fashion.

18. The apparatus according to claim 15, including a further swiveling housing element for which there is likewise provided a locking device with a locking element held on the further housing element and a complementary locking element held on the housing body, wherein the locking device for the further swiveling housing element is coupled with at least one of the other locking devices such that it is lockable and unlockable together with the other locking device.

19. The apparatus according to claim 1, wherein the display device comprises a touch-sensitive display.

20. The apparatus according to claim 1, wherein the housing element carries at least one further interface component.

21. The apparatus according to claim 20, including a bus system connecting the display device and the interface component or two interface components carried by the housing element at least to the control device.

22. The apparatus according to claim 21, wherein the bus system supplies electrical energy to the electrical components carried by the housing element and connected to the bus system.

* * * * *